United States Patent [19]

Heft

[11] 4,346,358

[45] Aug. 24, 1982

[54] CONTACT POP RESPONSIVE LATCH RELEASE FOR CIRCUIT BREAKERS

[75] Inventor: Eldon B. Heft, West Hartford, Conn.

[73] Assignee: General Electric Company, New York, N.Y.

[21] Appl. No.: 225,496

[22] Filed: Jan. 16, 1981

[51] Int. Cl.[3] ..... H01H 75/00; H01H 75/12; H01H 77/00

[52] U.S. Cl. ..... 335/16; 335/175; 335/195

[58] Field of Search ..... 335/16, 195, 175

[56] References Cited

U.S. PATENT DOCUMENTS 4,255,732 3/1981 Wafer et al. ..... 335/16

4,259,651 3/1981 Yamat ..... 335/16

*Primary Examiner*—Harold Broome

*Attorney, Agent, or Firm*—Richard A. Menelly; Walter C. Bernkopf; Fred Jacob

[57] ABSTRACT

A rearward extension of a circuit breaker pivotally mounted movable contact arm is positioned, with the arm in its closed position, to engage a trip bar and trip the breaker in response to popping movement of the arm away from its closed position as induced by the flow of high level fault current. The trip bar is configured such that the circuit breaker is not tripped incident to manual operation of the movable arm between its open and closed positions.

6 Claims, 8 Drawing Figures

CONTACT POP RESPONSIVE LATCH RELEASE FOR CIRCUIT BREAKERS

BACKGROUND OF THE INVENTION

The present invention relates to automatic electric circuit breakers, and particularly to a circuit breaker having increased current interrupting capacities.

Manufacturers of automatic electric circuit breakers are increasingly being faced with the task of developing new circuit breaker designs and upgrading existing circuit breaker designs to achieve higher current interrupting capacities in order to cope with the ever increasing current availables posed by modern utilities. That is, due to the updating of electrical utility equipment, the magnitude of current available to feed a circuit fault has increased significantly, and it becomes the task of the circuit breaker protecting the faulted circuit to safely interrupt this higher fault current. Thus, the interrupting capacity of a circuit breaker has become a most critical performance parameter.

The most direct approach to achieving increased interrupting capacity is to provide a fast acting circuit breaker. That is, a circuit breaker will have an easier interrupting task if it is capable of effecting and maintaining contact separation early in a fault current wavefront and thereby begin developing an arc voltage in opposition to the fault current driving voltage before the fault current achieves its prospective peak. This is due to the fact that such early development of an arc voltage is effective in cresting the fault current at an actual peak amplitude which is less than its prospective peak amplitude.

When a typical circuit breaker is subjected to high level fault currents, the movable contact arms can be literally blown away from their closed positions by the electrodynamic forces associated with such high level fault currents. This contact separation or so-called "pop" can occur relatively early in the fault current wavefront. Unfortunately, unless the breaker trip unit can act to trip the breaker before the first current zero, i.e., within the first half cycle of the fault current wave, the contact gap is reduced and, in fact, the contacts may even re-engage. The arcs drawn between the contacts as they pop do not contribute to the ultimate interruption which can only begin as the circuit breaker is tripped. Rather, these spurious arcs have deleterious effects on the circuit breaker. They needlessly erode contact material. The arc chutes are contaminated with ionized gases which degrade their dielectric strength and thus jeopardize their ability to extinguish the arcs drawn between the contacts when the circuit breaker is subsequently tripped to commence interruption of the circuit. Moreover, these spurious arcs contribute to an excessive build-up of internal gas pressures often sufficient to rupture the circuit breaker molded case.

It would be highly advantageous to utilize this "popping" motion of the breaker movable contact arms to trigger the final interruption of high level fault currents. That is, if the contact gap created by electrodynamic forces associated with the fault current could be not only sustained but rapidly increased to that gap produced when the arms achieve their final circuit interrupting position, the prospects for a successful interrupt are materially enhanced. In this case, the arcs associated with contact pop are not spurious, but in fact begin the requisite rapid build-up of arc voltage in opposition to the system driving voltage in current limiting fashion.

U.S. Pat. Nos. 3,505,622 and 3,534,305 contain disclosures of prior approaches to this end.

It is accordingly an object of the present invention to provide an automatic electric circuit breaker having materially improved current interrupting capacity.

A further object is to provide a circuit breaker of the above character wherein the popping of the breaker contacts is utilized as a beneficial, contributing factor in the successful interruption of a high level fault current.

An additional object is to provide a circuit breaker of the above character wherein popping of the breaker contacts triggers a circuit breaker trip early in the wavefront of a high level fault current.

Another object is to provide a circuit breaker of the above character wherein the facility to trip the circuit breaker in response to popping of the breaker contacts can be economically and efficiently incorporated in circuit breakers of existing design.

Other objects of the invention will in part be obvious and in part appear hereinafter.

SUMMARY OF THE INVENTION

In accordance with the present invention, there is provided a circuit breaker of improved current interrupting capacity wherein popping of its contacts caused by the flow of high level fault is utilized to trigger the breaker's successful interruption of the fault current. That is, contact pop is communicated directly to the circuit breaker's trip unit such as to initiate tripping of the breaker's contact operating mechanism at an earlier point in time than the trip unit itself can trip the breaker in reaction to a high level fault current. To this end, each of the breaker elongated movable arms is provided, at its other end from the end to which the breaker movable contact is affixed, with an extension whose termination is poised, with the arm in its closed position, in trip impacting relation with a common trip bar of the trip unit. Thus, when any one of these arms is blown away from its closed position by the electrodynamic forces associated which high level fault currents, the trip bar is impacted to immediately initiate tripping of the circuit breaker. Depending on the magnitude of the fault current, tripping of the circuit breaker by the popping movement of one of its movable contact arms can occur considerably earlier in the fault current wavefront, on the order of several milliseconds earlier, than the electromagnetic elements of the trip unit itself can trip the breaker in responding to the fault current.

As an additional feature of the invention, the trip bar is configured with the geometry of the movements of the arm in mind such that the breaker is not tripped when manually operated to articulate the arms between their open and closed positions.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings in which:

DESCRIPTION OF THE DRAWINGS

Corresponding reference numerals refer to like parts throughout the several views of the drawings.

DETAILED DESCRIPTION

Figure 1:
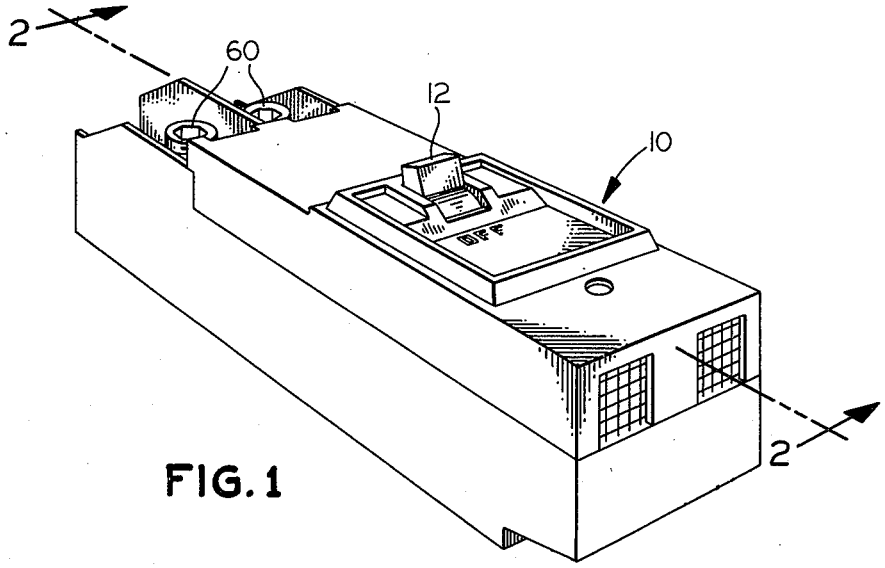
FIG. 1 is a perspective view of a two-pole molded case circuit breaker utilizing the present invention.

The present invention is utilized in a two-pole molded case circuit breaker, generally indicated at 10 in FIG. 1, whose construction and operation is detailed in commonly assigned U.S. Pat. No. 3,786,382, the disclosure of which is specifically incorporated herein by reference. As seen in this patent and in FIG. 2 herein, the operating mechanism for circuit breaker 10 includes a manual operating handle 12 pivotally mounted on a pin 13 supported between a pair of parallel, spaced frame sideplates, one seen at 14, positionally located with the breaker molded case 16. The lower extremity of the handle carries a pin 17 whose ends protrude through and move along an arcuate guide slot 14*a* in frame sideplates 14. Pivotally connected to this pin 17 is the upper end of a collapsible toggle linkage consisting of an upper link 18 and a lower link 20 pivotally interconnected by a knee pin 22. Lower link carries a transverse pin 24 on which is pivotally mounted a latch lever 26 serving to latch the toggle linkage in its straightened condition seen in FIG. 2. A torsion spring 27 biases this latch to its illustrated latching position. The two movable contact arms 28 of two-pole breaker 10 are pivotally mounted to the free ends of transverse pin 24, all as described below and in the above-noted U.S. Pat. No. 3,786,382.

Figure 2:
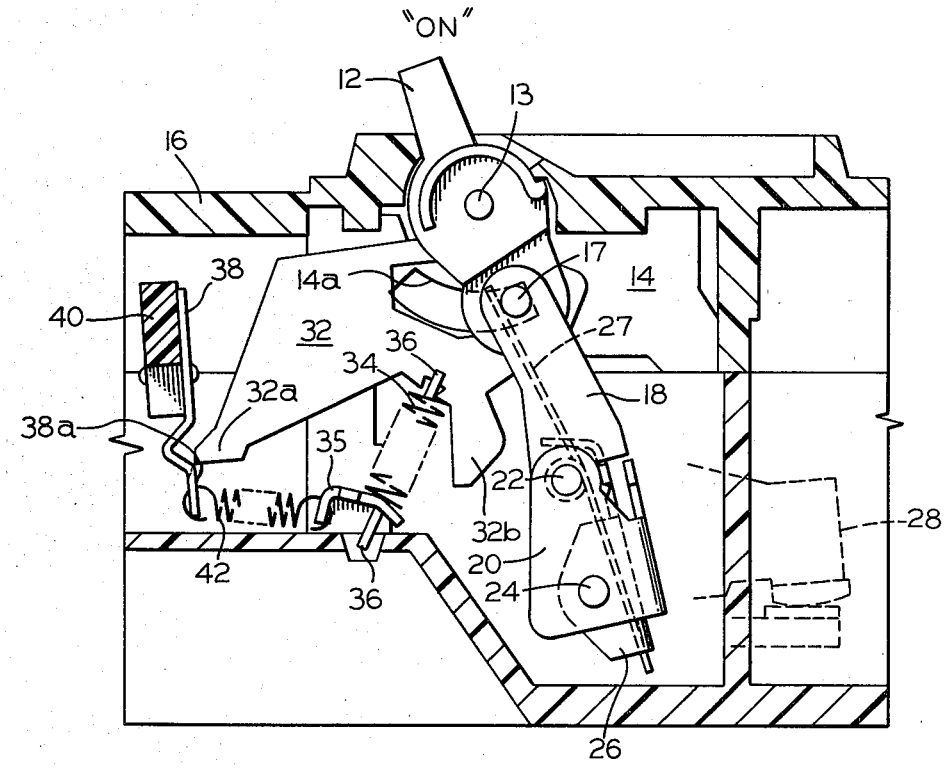
FIG. 2 is a fragmentary sectional view taken along line 2—2 of FIG. 1, showing the breaker operating mechanism in its closed or ON condition.
Figure 3:
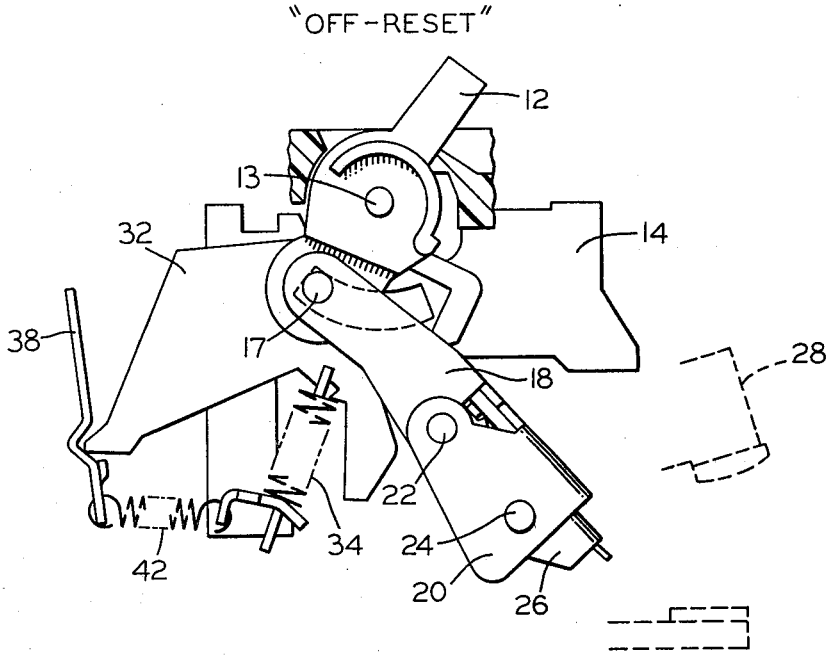
FIG. 3 is a simplified side elevational view depicting the operating mechanism of the circuit breaker of FIG. 1 in its open or OFF condition.

As long as latch 26 sustains the straightened condition of the toggle linkage, pivotal movement of handle 12 between its counterclockwise-most ON position of FIG. 2 and its clockwise-most OFF position of FIG. 3 is communicated to the movable contact arms 28 pursuant to articulating them between their closed and open circuit positions. As pointed out in the above-noted patent, this articulation of the movable contact arms is characterized by sequential, opposite directed rotational movements about pin 24 as the toggle linkage is propelled generally upwardly and downwardly against the upward bias of operating mechanism springs 30 (FIGS. 5–8).

To accommodate overcurrent tripping of circuit breaker 10, a trigger 32 is pivotally mounted by pin 13. A compression spring 34, bottomed against a brace 35 interconnecting the frame sideplates 14 and acting via a guide rod 36, biases the trigger in the counterclockwise direction seen in FIG. 2. Pivotal movement of the trigger is, however, normally inhibited by the engagement of its tip 32*a* with a latching edge surface 38*a* provided by a latch element 38 depending from a transversely elongated, rotatably mounted common trip bar 40. A tension spring 42, hooked between the lower end of the latch element and brace 35, biases the former to its position of latching engagement with the trigger 32.

Figure 6:
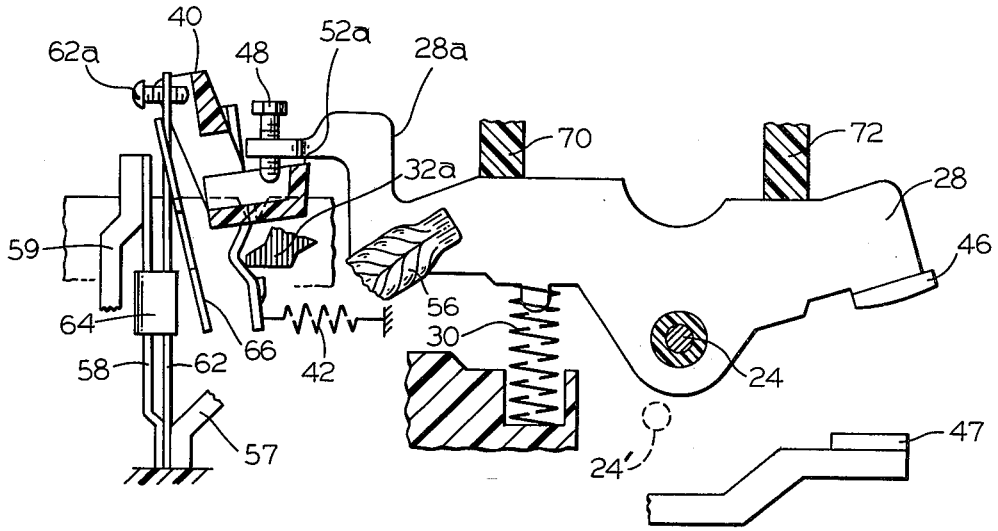
FIG. 6 is a side elevational view of the common trip bar and movable contact arm of FIG. 5 with the latter in its open position.

In the event of an overcurrent condition sensed by the current responsive elements of the breaker's trip unit, shown in the above-noted patent and FIG. 6 herein, trip bar 40 is rotated in the clockwise direction to release trigger 32. As the trigger is propelled in the counterclockwise direction by spring 34, an extension 32*b* thereof impacts against latch 26, causing the toggle linkage to be unlatched from its straightened condition of FIG. 2. The operating mechanism springs are then empowered to propel the movable contact arms 28 away from their closed position, in the process collapsing the toggle linkage to its condition of FIG. 4 as the arms assume their open position shown.

Figure 4:
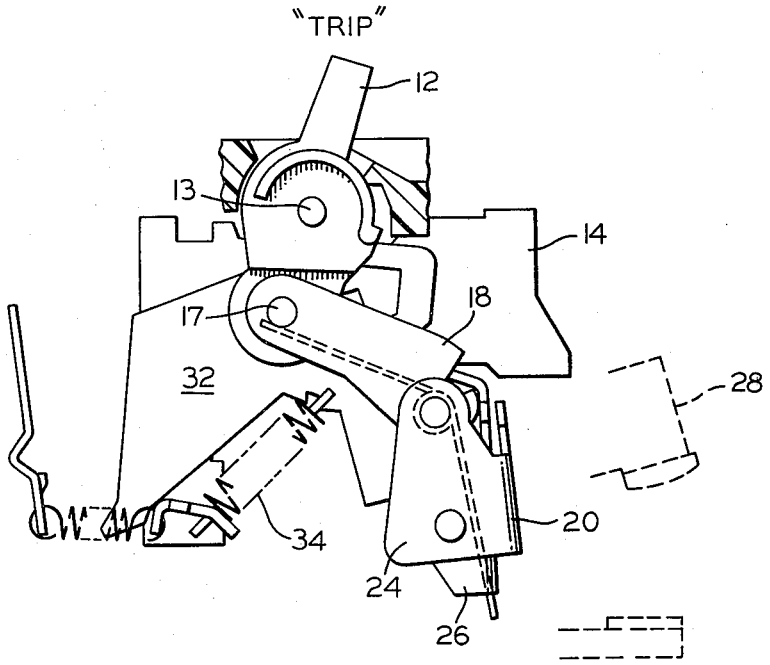
FIG. 4 is a simplified side elevational view depicting the operating mechanism of the circuit breaker of FIG. 1 in its tripped condition.

To reset the breaker operating mechanism from its tripped open condition of FIG. 4, the operating handle 12 is pivoted to its clockwise-most OFF position of FIG. 3. This causes the toggle linkage to be relatched in its straightened condition and trigger 32 to be returned to its position of latching engagement with latch element 38.

The foregoing is basically a summarization of the construction and operation of the circuit breaker disclosed in the above-noted U.S. Pat. No. 3,786,382 to which reference may be made for further details. The description to follow pertains to the instant invention whereby unique structural features are added in an efficient and economical manner to dramatically increase the breaker's current interrupting capacity.

Figure 5:
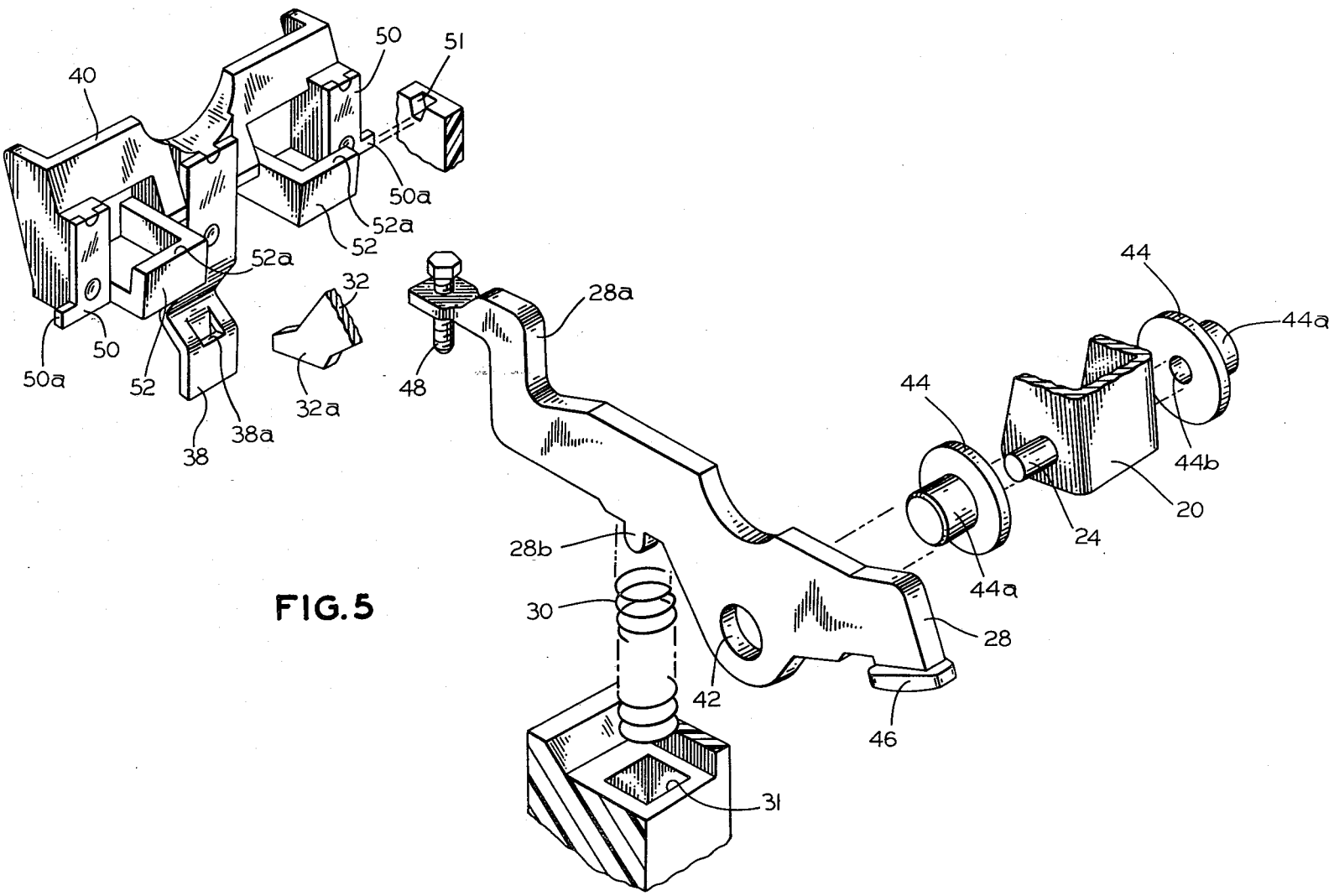
FIG. 5 is an exploded perspective view depicting one of the movable contact arms and a common trip bar as constructed in accordance with the present invention and utilized in the circuit breaker of FIG. 1.

Turning to FIG. 5, movable contact arm 28 of each of the two breaker poles is provided with a hole 42 which receives the hub 44*a* of an insulative grommet 44. The ends of pin 24, carried at the lower end of lower toggle link 20, are inserted into central bores 44*b* in the grommets pursuant to insulatively, pivotally mounting the movable arms to the toggle linkage, as generally described above. In accordance with the present invention, the end of each arm 28 opposite its end to which movable contact 46 is affixed is provided with a rearward extension 28*a*. The terminal portion of each extension is provided with a threaded bore through which a vertically oriented screw 48 is adjustably, threadedly advanced. Trip bar 40 is seen in FIG. 5 to be equipped with fittings 50 riveted to each end. These fittings provide laterally projecting ears 50*a* which are lodged in notches 51 provided in the breaker case sidewalls pursuant to pivotally mounting the trip bar in a transverse position spanning the two breaker poles. The trip bar, formed of electrically insulative plastic, is molded with a pair of forwardly extending projections 52 respectively longitudinally aligned with the two breaker poles. Each projection terminates in a raised, transversely elongated shoulder 52*a*. Depending latch element 38 is affixed to the trip bar at a location between projections 52. FIG. 5 shows the operating mechanism springs 30 to be seated in deep, rectangular wells 31 molded into the floor of the breaker case in each breaker pole, while with their upper ends embrace locating bumps 28*b* to maintain engagement with the lower edges of their respective movable arms 28.

Turning to FIG. 6, current flowing through the movable arm in each breaker pole is conducted by a braid 56 to a strap 57 and thence through an upstanding heater 58 and a load strap 59 to a load terminal lug 60, seen in FIG. 1. incorporated in the electrical joint between strap 57 and heater 58 is the lower end of an elongated bimetal 62 which projects upwardly in proximate, thermally coupled relation with the heater. The upper end of the bimetal carries a calibrating screw 62*a* whose tip is poised to engage and rotate the trip bar in the clockwise direction to trip the breaker as the bimetal deflects rightward in time delayed response to heat generated by the heater when conducting current of overload proportions.

In addition to the thermal trip elements, bimetal 62 and heater 58 in each breaker pole, the breaker's trip unit includes electromagnetic trip elements in the form of a U-shaped magnetic field piece 64 mounted in partially embracing relation to each heater and separate, pivotally mounted armatures 66. To effect magnetic tripping of the circuit breaker without intentional delay when current of heavy overload and short circuit proportions flows through either of the breaker pole circuits, the flux developed in the pole piece magentically attracts its associated armature to an actuated position, in the process engaging and rotating the trip bar to trip the breaker. Unfortunately, the response of these magnetic trip elements in the circuit breaker trip unit, while without intentional delay, is not sufficiently abrupt to achieve current limitation, that is, trip the breaker soon enough to crest a fault current wave at a peak amplitude below its prospective peak. Thus, but for the present invention, circuit breaker 10 is left with a rather modest current interrupting capacity.

Figure 7:
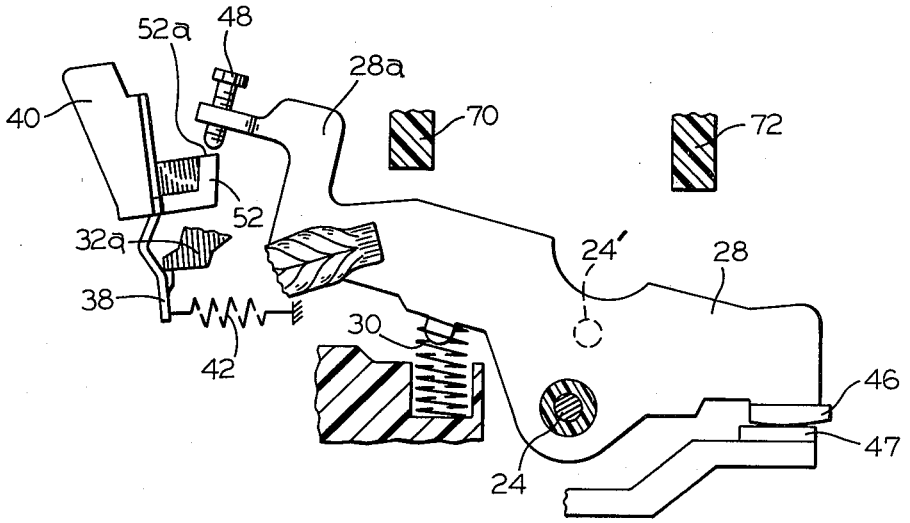
FIG. 7 is a side elevational view of the common trip bar and movable contact arm of FIG. 5 with the latter in its closed position.
Figure 8:
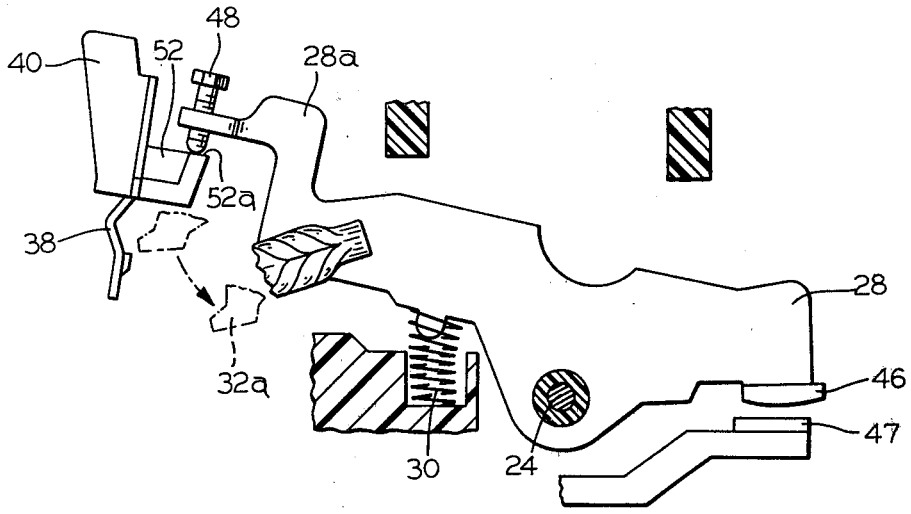
FIG. 8 is a side elevational view of the common trip bar and movable contact arm of FIG. 5, with the latter in a popped, trip initiating position.

By virtue of the present invention, when the movable arms 28 are in their closed position with movable contacts 46 engaging stationary contacts 47, the tips of screws 48 are poised immediately above their respective shoulders 52*a* of trip bar projections 52, as seen in FIG. 7. It will be noted that compression springs 30 are then charged to exert a clockwise moment on their respective arms about the arm pivotal mounting pin 24, thereby imposing the requisite contact pressures on the engaged movable and stationary contacts. When a high level fault current flows through either breaker pole, the electrodynamic forces associated therewith develop a counterclockwise moment on the arm therein in opposition to its spring 30. In the case of excessively high fault currents, spring 30 is overpowered, and the contacts pop, i.e., the arm is repelled through an increment of counterclockwise pivotal movement. As seen in FIG. 8, this popping motion of either or both arms 28 swings the tips of screws 48 downward into impacting engagement with their associated shoulders 52*a* of the trip bar. The resulting clockwise movement of the trip bar releases trigger 32, and the breaker is tripped forthwith. With the resulting defeat of the toggle linkage latch, springs 30 discharge to take over from the fault current repulsion forces in expanding the contact gaps to the full tripped open dimensions seen in FIG. 6 with the arms abutted against cover mounted stops 70 and 72. It should be noted that, for purposes of the present invention, pins 77 seen in FIGS. 1 and 2 of U.S. Pat. No. 3,786,382 are eliminated so as not to impede popping motion of the movable contact arms.

I have found that in the disclosed imbodiment, the breaker can be effectively tripped in this fashion in response to contact pop resulting in a gap of as little as one thirty-second of an inch. Of course, the speed at which this requisite contact gap is created depends on the amplitude of fault current wavefront. That is, the higher the amplitude, the shorter the interval between the onset of the fault current and the achievement of the trip initiating contact gap. On the other hand, it is found that the response time of the magnetic elements in the breaker's trip unit is essentially uniform for virtually all levels of overcurrent. I have found that, by virtue of the present invention, contact separation marking the initiation of the interruption process can be achieved as soon as four milliseconds from the onset of the fault current wave, which is sufficiently early to effect current limitation. However, if the interruption process is left to the breaker's trip unit, contact separation to begin the interruption process does not occur until eight milliseconds into the fault current wave. Thus, implementation of the present invention in a circuit breaker constructed in accordance with the disclosure of the above-noted U.S. Pat. No. 3,786,382 results in a dramatic increase in interrupting capacity, e.g. from 10,000 to 22,000 amperes.

Referring to FIG. 6, it is seen that when the circuit breaker is manually operated to its OFF condition of FIG. 3, the tips of screws 48 are shifted to a position rearwardly of raised shoulders 52*a* in non-engaging relation with trip bar projections 52. Moreover, as the movable arms 28 are manually articulated between their open position of FIG. 6 and closed position of FIG. 7, engagement of these screws with the trip bar projections is avoided. Thus trigger 32 is not released to initiate unintended tripping of the breaker while being manually operated between its ON and OFF conditions. This is achieved by virtue of the illustrated configuration of the trip bar projections, coupled with character of the movable arm articulation. That is, not only do the arms pivot about their mounting pin 24, the position of the pin itself is shifted up and down as the breaker is manually operated between its OFF and ON conditions.

Thus, as the breaker is manually operated to its ON condition from its OFF condition, arm mounting pin 24 is propelled downwardly toward its ultimate position of FIG. 7 (illustrated in phantom at 24' in FIG. 6). The arms initially rock in the clockwise direction about fulcrums constituted by the engagement of the arms with stops 70, as imposed by springs 30. This elevates the tips of screws 48 above shoulders 52*a*. Before pin 24 reaches its ultimate position 24', the contacts engage to create new fulcrums about which the arms swing in the counterclockwise direction, bringing the tips of screws 48 downwardly to their positions of FIG. 7, poised immediately above their associated shoulders 52*a*.

From the ON to the OFF conditions, the sequence is reversed. As the operating handle is pivoted clockwise, the arm pivot pin 24 is drawn upwardly toward its ultimate elevated position (illustrated in phantom at 24' in FIG. 7) under the influence of springs 30. Initially, the arms swing clockwise about the fulcrums imposed by the engaging contacts. This elevates the tips of screws 48 well above shoulders 52*a*. When the arms encounter abutments 70, fulcrums are established thereat about which the arms swing in the counterclockwise direction. The tips of the screws 48 then swing downwardly to their positions of FIG. 6, passing rearwardly beyond the shoulders.

It is pointed out that the present invention can be incorporated with equal facility and comparable performance improvement in the three-pole circuit breaker disclosed in commonly assigned U.S. Pat. No. 4,166,988. Moreover, it will be appreciated that the teachings of the present invention may be applied to new and existing circuit breaker designs other than those specifically referred to herein.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described my invention, what I claim as new and desired to secure by Letters Patent is:

1. An improved circuit breaker of the type comprising, in combination:

at least one elongated, electrically conductive arm;

a movable contact affixed to one end of said arm;

a stationary contact;

an operating mechanism including a one-piece, pivotally mounted trigger, a pin pivotally mounting said arm intermediate its end, and a spring exerting a moment in said arm about said pin a trip mechanism including a latch normally sustaining said trigger in a reset position to enable said operating mechanism to articulate said arm between an open position with said contacts in spaced relation and a closed position with said contacts in engaged relation, said spring moment exerting contact pressure on said engaging contacts, and trip elements responsive to current of overcurrent proportions flowing through said engaging contacts for actuating said latch to release said trigger, whereupon said operating mechanism articulates said arm from its closed to its open position as said spring discharges;

the improvement which comprises:

a rigid extension provided at the other end of said arm, with said arm in its closed position, said extension disposing its termination in actuating relation with said latch, whereby pivotal movement of said arm about said pin in opposition to said spring moment, as motivated by the flow of high level fault currents through said contacts causes said extension to actuate said latch and release said trigger before said trip elements can react to the fault current.

2. The circuit breaker defined in claim 1, wherein said trip mechanism further includes a trip bar, said trip elements and said extension acting on said trip bar pursuant to actuating said latch.

3. The circuit breaker defined in claim 2, which further includes a manual operating handle mechanically coupled with said arm pivotal mounting pin, manipulation of said handle between its OFF and ON positions articulating said arm between its open and closed positions, the character of said arm articulations being such as to avoid engagement of said extension termination with said trip bar, whereby to avoid actuation of said latch during manual operation of the circuit breaker.

4. A circuit breaker comprising, in combination:

an operating mechanism including a one-piece, pivotally mounted trigger, a pin pivotally mounting said arm intermediate its ends, and a spring exerting a moment in said arm about said pin;

a trip mechanism including a latch normally sustaining said trigger in a reset position to enable said operating mechanism to articulate said arm between an open position with said contacts in spaced relation and a closed position with said contacts in engaged relation, said spring moment exerting contact pressure on said engaging contacts, and trip elements responsive to current of overcurrent proportions flowing through said engaging contacts for actuating said latch to release said trigger, whereupon said operating mechanism articulates said arm from its closed to its open position as said spring discharges; and a rigid extension provided at the other end of said arm, with said arm in its closed position, said extension disposing its termination in actuating relation with said latch, whereby pivotal movement of said arm about said pin in opposition to said spring moment, as motivated by the flow of high level fault currents through said contacts causes said extension to actuate said latch and release said trigger before said trip elements can react to the fault current; and a pair of elongated, electrically conductive arms mounting movable contacts at their one ends for respective engagement with a pair of stationary contacts, said arms being pivotally mounted intermediate these ends by said pin, and a pair of springs exerting separate moments on said arms, said trip mechanism further including plural trip elements individually responsive to the currents flowing through the respective pairs of engaging movable and stationary contacts and a common trip bar operatively coupled with said latch such that either of said trip elements actuates said latch via said trip bar to release said trigger, each said arm being provided with a separate rigid extension at its other end for disposal in proximate relation with said trip bar such that pivotal movement of either said arm about said pin in opposition to its spring moment produces actuation of said latch via said trip bar, said trip bar including a pair of upwardly raised shoulders, and said arm extensions being provided at their free ends with downwardly extending projections, with said arms in their closed positions, the terminations of said projections being respectively disposed in proximate relation with said shoulders.

5. The circuit breaker defined in claim 4, which further includes a manual operating handle mechanically coupled with said arm pivotal mounting pin, manipulation of said handle between its OFF and ON positions pursuant to articulating said arms between their open and closed positions shifts the position of said pin in a manner such as to avoid engagements of said projection terminations with said trip bar shoulders, whereby to avoid actuation of said latch to release said trigger during manual operation of the circuit breaker.

6. The circuit breaker defined in claim 5, wherein said projections are in the form of screws adjustably threaded through said arm extension free ends.

* * * * *